US011953220B2

(12) United States Patent
Kurihara et al.

(10) Patent No.: US 11,953,220 B2
(45) Date of Patent: Apr. 9, 2024

(54) COMFORT-ANALYZING DEVICE, ENVIRONMENT-CONTROL COMMAND DEVICE, AND COMFORT-ANALYZING METHOD

(71) Applicant: Mitsubishi Electric Corporation, Tokyo (JP)

(72) Inventors: Kota Kurihara, Tokyo (JP); Seiro Yuge, Tokyo (JP); Makoto Takata, Tokyo (JP); Noriko Nagata, Hyogo (JP); Masashi Sugimoto, Hyogo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/908,538

(22) PCT Filed: Mar. 18, 2020

(86) PCT No.: PCT/JP2020/011989

§ 371 (c)(1),
(2) Date: Sep. 1, 2022

(87) PCT Pub. No.: WO2021/186615

PCT Pub. Date: Sep. 23, 2021

(65) Prior Publication Data

US 2023/0123057 A1 Apr. 20, 2023

(51) Int. Cl.

| | |
|---|---|
| ***F24F 11/52*** | (2018.01) |
| ***F24F 11/56*** | (2018.01) |
| *F24F 120/20* | (2018.01) |

(52) U.S. Cl.

CPC ..... *F24F 11/52* (2018.01); *F24F 11/56* (2018.01); *F24F 2120/20* (2018.01)

(58) Field of Classification Search

CPC ..... F24F 11/52; F24F 11/56; F24F 2120/20
See application file for complete search history.

(56) References Cited

U.S. PATENT DOCUMENTS 5,615,134 A 3/1997 Newsham et al.
7,296,064 B2 * 11/2007 Yoon ..... H04N 21/4532 709/224

(Continued)

FOREIGN PATENT DOCUMENTS

EP 3587945 A1 1/2020
JP 4-250315 A 9/1992

(Continued)

OTHER PUBLICATIONS

International Search Report and Written Opinion dated Aug. 25, 2020, received for PCT Application PCT/JP2020/011989, filed on Mar. 18, 2020, 11 pages including English Translation.

(Continued)

*Primary Examiner* — Mohammad Ali
*Assistant Examiner* — Vincent W Chang
(74) *Attorney, Agent, or Firm* — XSENSUS LLP

(57) ABSTRACT

A comfort-analyzing device includes a display unit, a first control unit, an input unit, and a cognitive-structure constructing unit. The display unit is configured to present a questionnaire for extracting both a comfort level of a user in an environment and at least one environmental factor to determine the comfort level. The first control unit is configured to cause the display unit to present the questionnaire twice or more during a survey period. The input unit is configured to accept, from the user, input of each reply to the questionnaire presented twice or more. The cognitive-structure constructing unit is configured to construct a cognitive-structure model representing a cognitive structure of the user regarding comfort by extracting both the comfort level and the at least one environmental factor in chronological order based on each reply to the questionnaire presented twice or more.

13 Claims, 4 Drawing Sheets

(56) References Cited

U.S. PATENT DOCUMENTS

| | | | | |
|---|---|---|---|---|
| 2007/0138307 | A1* | 6/2007 | Khoo | F24F 11/30 236/1 C |
| 2014/0277765 | A1* | 9/2014 | Karimi | G05B 15/02 700/276 |
| 2014/0358291 | A1* | 12/2014 | Wells | G05B 15/02 700/276 |
| 2015/0213110 | A1 | 7/2015 | Araki | |
| 2016/0379634 | A1* | 12/2016 | Yamamoto | G10L 15/22 704/251 |
| 2017/0030607 | A1 | 2/2017 | Hirano et al. | |
| 2018/0266716 | A1* | 9/2018 | Bender | F24F 11/62 |
| 2019/0338974 | A1* | 11/2019 | Turney | F24F 11/65 |
| 2020/0134891 | A1* | 4/2020 | Ohta | F24F 11/523 |
| 2021/0140671 | A1* | 5/2021 | Francis | F24F 11/64 |
| 2021/0285671 | A1* | 9/2021 | Du | G05B 13/027 |

FOREIGN PATENT DOCUMENTS

| | | | |
|---|---|---|---|
| JP | 11-126293 | A | 5/1999 |
| JP | 2003-58687 | A | 2/2003 |
| JP | 2003-288439 | A | 10/2003 |
| JP | 2005-77066 | A | 3/2005 |
| JP | 2014-197373 | A | 10/2014 |
| JP | 2015-10723 | A | 1/2015 |
| JP | 2015-141530 | A | 8/2015 |
| JP | 2016-95066 | A | 5/2016 |
| JP | 2017-62060 | A | 3/2017 |
| WO | 2015/155978 | A1 | 10/2015 |
| WO | 2018/154660 | A1 | 8/2018 |
| WO | 2019013014 | A1 | 1/2019 |
| WO | WO-2019013014 | A1 * | 1/2019 ..... F24F 11/52 |

OTHER PUBLICATIONS

Munakata, "Building Environments and Resident Physiology/Psychology", Building Environments and Resident Psychology. Heating, Air-conditioning and Sanitation Engineering, Environmental Psychology, vol. 84, No. 8, 2010, pp. 787-794 (13 pages including English Translation).

Notice of Reasons for Refusal dated Apr. 27, 2021, received for JP Application 2021-504322, 4 pages including English Translation.

Decision to Grant dated Jul. 6, 2021, received for JP Application 2021-504322, 5 pages including English Translation.

Office Action dated Feb. 7, 2023 in Chinese Patent Application No. 202080098364.1, 14 pages.

Office Action dated Jan. 20, 2024 issued in corresponding CN patent application No. 202080098364.1 (and English Translation). 14 pages.

* cited by examiner

COMFORT-ANALYZING DEVICE, ENVIRONMENT-CONTROL COMMAND DEVICE, AND COMFORT-ANALYZING METHOD

CROSS-REFERENCE TO RELATED APPLICATION

The present application is based on PCT filing PCT/JP2020/011989, filed Mar. 18, 2020, the entire contents of which is incorporated herein by reference.

TECHNICAL FIELD

The present disclosure relates to a comfort-analyzing device, an environment-control command device and a comfort-analyzing method to be executed by the comfort-analyzing device, the comfort-analyzing device being configured to analyze comfort by an assessment that is input regarding the comfort, the environment-control command device being configured to give a command to an environment-control device for controlling an environment, the command being given based on an analysis result obtained by the comfort-analyzing device.

BACKGROUND ART

It is known that thermal comfort of a user in an environment is represented by an index known as the predicted mean vote (PMV), which is adopted by The International Organization for Standardization (ISO) and The American Society of Heating, Refrigerating and Air-Conditioning Engineers (ASHRAE). A PMV is calculated based on thermal environmental factors and personal factors. Examples of the thermal environmental factors include an air temperature, a humidity level, an air velocity, and a radiant temperature indicating heat radiated by a surrounding wall. Examples of the personal factors include the amount of clothing, a metabolic rate, and a level of activity.

A state having a PMV value within ±0.5 or a predicted percentage dissatisfied less than or equal to 10% is recommended as a comfortable environment. The predicted percentage dissatisfied represents a predicted value of a percentage of users who feel uncomfortable in an environment at a given PMV value. Thus, technologies are available to change a PMV value by controlling thermal environmental factors that affect the PMV value in a room and improve the comfort level of a user. However, since the sense of heat experienced by a person, which is a sensation caused by heat or cold, varies from person to person, some users may fail to feel comfortable in real life even in a recommended environment having a PMV value within ±0.5, and the percentage of dissatisfied people may exceed 10% in such an environment. In summary, the comfort that a person experiences in a thermal environment of a room is a subjective index, and it is possible that there is not necessarily one-to-one correspondence between such comfort and an objective index such as a PMV. In contrast, there are a few methods for controlling a thermal environment customized to the need of an individual user. In such methods, differences among individuals are determined based on reports from users on subjective thermal characteristics, and the thermal environment is controlled based on the differences among individuals.

A thermal-characteristics assessment device according to Patent Literature 1 is configured to acquire thermal characteristics based on a subjective point of view of a user.

Specifically, the thermal-characteristics assessment device acquires an assessment of the air temperature in a surrounding environment from the user, the assessment being rated on a discrete scale based on a subjective point of view of the user. For example, the thermal-characteristics assessment device acquires an assessment rated as one of three levels, "hot", "comfortable", and "cold", from the user. In this way, the thermal-characteristics assessment device acquires thermal characteristics indicating, for example, whether the user is sensitive to heat or cold or oversensitive to cold.

The thermal-characteristics assessment device includes a database in which skin-temperature distributions obtained at a room temperature assessed as a comfortable temperature are categorized into multiple patterns. The comfortable temperature is a temperature rated as, for example, "comfortable" by a subject. The database is created based on measurements of skin-temperature distributions of multiple subjects. The pattern is referred to as a thermal type. The thermal type is specified by a comfortable room temperature, the average value of skin temperatures, and the standard deviation of skin temperatures as parameters for determining differences among individuals.

The thermal-characteristics assessment device acquires skin temperatures measured by a temperature-measuring device at multiple specified body positions of a user in a thermal environment at a temperature assessed as comfortable based on thermal characteristics acquired for the user. Then, the thermal-characteristics assessment device determines the thermal type of the user based on a room temperature at which the user feels comfortable, skin temperatures at multiple specified positions of the user, and other parameters and comparing these parameters with the content of the database. Thereafter, the room environment is controlled based on the information regarding the thermal type.

CITATION LIST

Patent Literature

Patent Literature 1: Japanese Unexamined Patent Application Publication No. 2015-10723

SUMMARY OF INVENTION

Technical Problem

The thermal-characteristics assessment device described above is configured to categorize individuals only based on the information acquired once in advance. However, factors that affect the comfort are expected to change over time because of, for example, activities and variations in the physical condition of a user during a day. For example, even in a static room environment, a subjective comfort level of a person and factors causing comfort or discomfort can change during a series of activities such as entering the room, staying in the room, working, resting, and exiting the room. Thus, information that clearly links the comfort level of a user and one or more factors affecting the comfort of the user is expected to be needed as a function of time to analyze the comfort of the user and control the environment so that the user feels comfortable.

To address the problems described above, an object of the present disclosure is to provide a comfort-analyzing device and an environment-control command device, the comfort-analyzing device being configured to extract, in chronological order, both a comfort level of a user and at least one environmental factor that determines the comfort level and construct a cognitive-structure model precisely representing a cognitive structure of the user, the environment-control command device being configured to give a command to an environment-control device for controlling an environment, the command being given based on the information obtained by the comfort-analyzing device.

Solution to Problem

A comfort-analyzing device according to an embodiment of the present disclosure includes a display unit configured to present a questionnaire for extracting both a comfort level of a user in an environment and at least one environmental factor to determine the comfort level; a first control unit configured to cause the display unit to present the questionnaire twice or more during a survey period; an input unit configured to accept, from the user, input of each reply to the questionnaire presented twice or more; and a cognitive-structure constructing unit configured to construct a cognitive-structure model representing a cognitive structure of the user regarding comfort by extracting both the comfort level and the at least one environmental factor in chronological order based on each reply to the questionnaire presented twice or more.

An environment-control command device according to an embodiment of the present disclosure is configured to give a command to one or more environment-control devices based on an analysis result obtained by a comfort-analyzing device, the one or more environment-control devices being configured to control environment, the comfort-analyzing device being configured to present a questionnaire for extracting both a comfort level of a user in an environment and at least one environmental factor to determine the comfort level, the questionnaire being presented twice or more during a survey period, accept, from the user, input of each reply to the questionnaire presented twice or more, construct a cognitive-structure model representing a cognitive structure of the user regarding comfort by extracting both the comfort level and the at least one environmental factor in chronological order based on each reply to the questionnaire presented twice or more, and analyze a property of the user relevant to comfort of the user based on the cognitive-structure model, the environment-control command device includes a first communication unit configured to acquire an analysis result representing the property of the user from the comfort-analyzing device; a condition-calculating unit configured to calculate an environmental condition for the user based on the analysis result acquired by the first communication unit; a second communication unit configured to communicate with the one or more environment-control devices; and a second control unit configured to cause the second communication unit to transmit, to the one or more environment-control devices, a command to cause the one or more environment-control devices to perform a process based on the environmental condition calculated by the condition-calculating unit.

Advantageous Effects of Invention

The comfort-analyzing device according to an embodiment of the present disclosure can extract, in chronological order, both a comfort level of a user and at least one environmental factor that determines the comfort level based on each reply from the user to a questionnaire presented twice or more during a survey period, and the comfort-analyzing device of an embodiment of the present disclosure can construct a cognitive-structure model precisely representing a cognitive structure of the user.

DESCRIPTION OF EMBODIMENTS

Hereinafter, embodiments will be described with reference to the drawings. Components in the following drawings are not necessarily drawn to scale.

Embodiment 1

Figure 1:
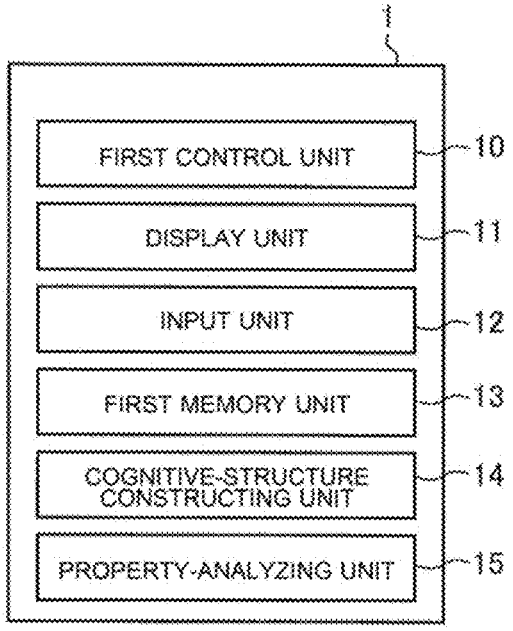
FIG. 1 is a diagram illustrating functional blocks of a comfort-analyzing device according to Embodiment 1.

FIG. 1 is a diagram illustrating functional blocks of a comfort-analyzing device according to Embodiment 1. A comfort-analyzing device 1 is configured to collect information regarding the comfort of a user based on the experience sampling method. The comfort-analyzing device 1 is configured to analyze a property of the user based on the collected information. The property of the user is necessary to provide a comfortable environment to the user. The experience sampling method is a survey method in which a procedure such as measurement or information collection is performed, for example, at a fixed time or at random, several times a day for several days on a survey target leading a daily life. The property of the user represents features of the user including the sensitivity to heat, the sensitivity to cold, a tendency to have cold limbs, a tendency to have an upset stomach, and having a muscular body and a high amount of fat burning. In Embodiment 1, for easy understanding, description will be given on the assumption that there is only one user.

As depicted in FIG. 1, the comfort-analyzing device 1 includes a first control unit 10, a display unit 11, an input unit 12, a first memory unit 13, a cognitive-structure constructing unit 14, and a property-analyzing unit 15. The first control unit 10 is configured to control the display unit 11, the input unit 12, the first memory unit 13, the cognitive-structure constructing unit 14, and the property-analyzing unit 15. The display unit 11 is configured to present a questionnaire in accordance with an instruction from the first control unit 10. The questionnaire is to ask a user about comfort.

The first control unit 10 is configured to cause the display unit 11 to present the content of the questionnaire, for example, at a fixed time or at random, multiple times a day for a period, such as several days or several months, which is set for the execution of the survey. A period set for the execution of the survey is referred to as a survey period in the following description. The input unit 12 is configured to accept input from the user to the comfort-analyzing device 1. The user enters a reply to the questionnaire into the comfort-analyzing device 1 every time the questionnaire is presented by the display unit 11, and the comfort-analyzing device 1 is able to collect information regarding comfort in chronological order. The information regarding comfort is information indicating a comfort level determined, for example, by the sense of heat or cold, an air temperature, a humidity level, a sound, a luminous intensity, weather, a lifestyle, or a physical condition.

Figure 2:
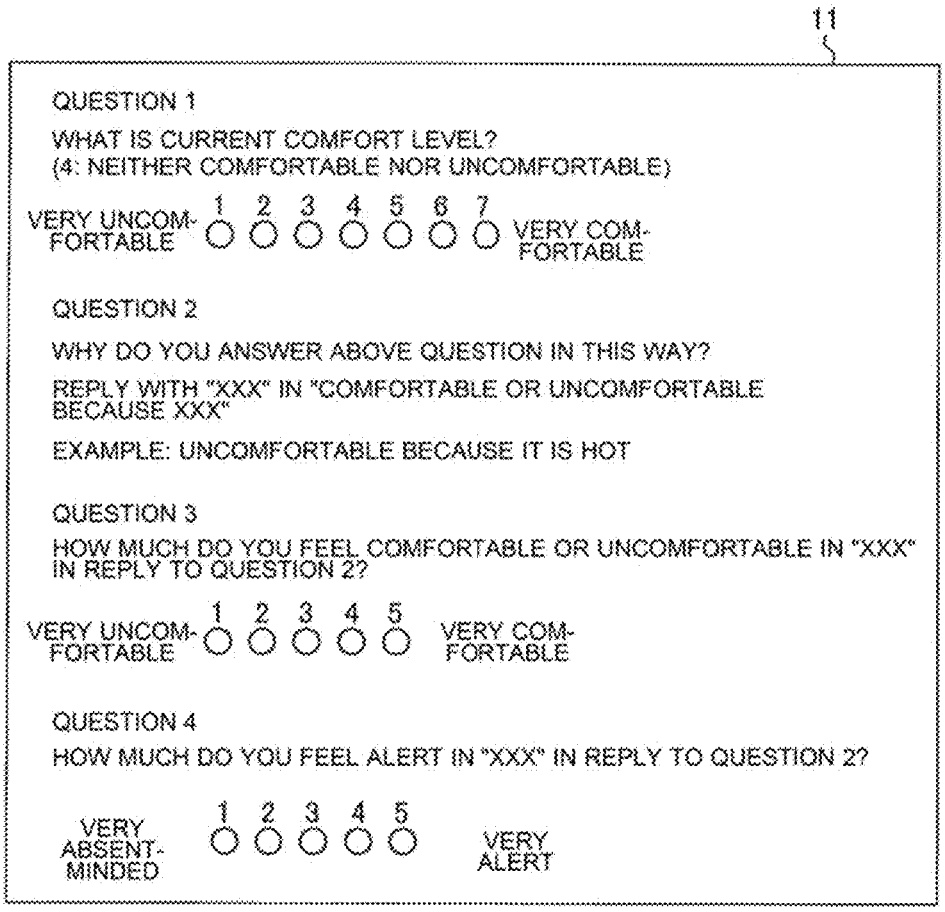
FIG. 2 is an illustration depicting an example of a questionnaire presented by a display unit according to Embodiment 1.

FIG. 2 is an illustration depicting an example of a questionnaire presented by the display unit according to Embodiment 1. The questionnaire allows the user to reply by a rating method and a free-description method. Question 1 in the questionnaire in FIG. 2 is based on a rating method and allows the user to rate the comfort level of the user in the current environment by numbers in seven levels. In the example depicted in FIG. 2, the comfort-analyzing device 1 allows the user to select one pointer from the pointers each assigned a natural number selected from "1" to "7". The user uses the input unit 12 and selects one pointer. Aside from pointers, the comfort-analyzing device 1 may allow the user to enter a number representing the comfort level. In the following description, for example, numerical data indicating a comfort level, such as one of the natural numbers from "1" to "7" described above, and text data indicating a comfort level, such as "comfortable" or "uncomfortable", are referred to as information indicating a comfort level. The information indicating a comfort level is also referred to simply as a comfort level.

In FIG. 2, as the number assigned to a pointer increases, the comfort level increases. For example, "1" indicates "very uncomfortable", and "7" indicates "very comfortable". In the example depicted in FIG. 2, the number of pointers is set to seven by way of non-limiting example, but the number may be, for example, five or any other number.

Question 2 in the questionnaire in FIG. 2 is to request a reply based on a free-description method. Question 2 is based on the laddering method and is to ask the user about the reason for the answer to Question 1. In other words, Question 2 is to ask the user about the reason that the user selects the number representing the comfort level in Question 1. For example, if the user selects a number representing "uncomfortable" in Question 1, Question 2 allows the user to reply with a text, such as "hot" or "cold", which describes why the user feels "uncomfortable".

Further, Question 2 also allows the user to reply with a factor causing the user to feel, for example, "hot" or "cold". For example, if the user feels hot because air-conditioning is not properly provided, the user also replies to Question 2 with a factor saying "air-conditioning is not properly provided". A factor related to an environment, such as "hot", "cold", or "air-conditioning is not properly provided" described above, is sometimes referred to as an environmental factor in the following description. The information regarding comfort, which is described above, includes not only a comfort level but also information indicating at least one environmental factor that determines the comfort level.

Further, in Question 3, the comfort-analyzing device 1 requests a reply regarding a level of pleasantness due to the environmental factor with which the user replies in Question 2. For example, the level of pleasantness is rated in five levels, each of which is represented by a pointer to which one of the natural numbers from "1" to "5" is assigned. As the number assigned to a pointer increases, the comfort level increases, and "1" indicates "very uncomfortable" while "5" indicates "very comfortable". In this way, in Question 3, the comfort-analyzing device 1 requests a reply regarding a comfort level due to the environmental factor with which the user replies in Question 2. The comfort-analyzing device 1 requests such a reply to extract an effect exerted on the sensation of the user by the environmental factor. The question also contributes to the improvement of the accuracy of a cognitive-structure model constructed by the cognitive-structure constructing unit 14, which will be described below, the cognitive-structure model representing the cognitive structure of the user. The cognitive-structure model is used to analyze the property of the user.

The comfort-analyzing device 1 is configured to not only collect the information regarding the comfort of the user but also collect the information indicating an alertness level or an absent-mindedness level of the user by presenting a questionnaire for asking the alertness level or the absent-mindedness level of the user. In the following description, the alertness level or the absent-mindedness level is collectively referred to as the alertness level. The comfort-analyzing device 1 collects the information indicating the alertness level to extract an effect exerted on the sensation of the user by an environmental factor. The information also contributes to the improvement of the accuracy of the cognitive-structure model constructed by the cognitive-structure constructing unit 14.

Referring back to FIG. 1, the first control unit 10 is configured to cause the display unit 11 to present the questionnaire illustrated in FIG. 2 and causes the input unit 12 to accept input of answers to the questions in the questionnaire. The first control unit 10 is configured to link the date and time when the input unit 12 accepts the input of the reply to the questionnaire and the information regarding the comfort that is input and save the date and time and the information to the first memory unit 13. The first control unit 10 is configured to then accumulate the information regarding the comfort in the first memory unit 13 during a survey period. By the questionnaire, which is based on the laddering method described above and which requests a reply based on a free-description method, the comfort-analyzing device 1 is able to acquire information indicating an environmental factor such as an air temperature, a humidity level, a sound, a luminous intensity, weather, a climate change, a lifestyle, or a physical condition, in addition to the sense of heat or cold. Further, by a survey based on the experience sampling method, the comfort-analyzing device 1 is able to acquire information regarding an ever-changing comfort level and environmental factor.

Other profits obtained by the experience sampling method are also described as follows. First, a survey based on the experience sampling method is unlikely to include recall bias of a respondent and is less susceptible to distortion of a reply. Second, since a survey result based on the experience sampling method has high temporal resolution, the comfort-analyzing device 1 easily extracts an effect exerted on comfort by an event that occurs at a specific time point. Third, since the comfort-analyzing device 1 collects data at multiple time points, it is possible to exclude various complicated factors that can occur in daily life, which are not related to comfort.

The cognitive-structure constructing unit 14 is configured to extract at least one environmental factor that affects comfort and construct a model representing a cognitive structure of the user regarding comfort. The at least one environmental factor is extracted from the survey result described above by the evaluation grid method. The model is referred to as a cognitive-structure model below. The cognitive-structure model reveals a cause-effect relationship between the comfort level and the at least one environmental factor and indicates the comfort level and the at least one environmental factor, which determines the comfort level, in a hierarchical manner. In the cognitive-structure model in Embodiment 1, information indicating at least one environmental factor is placed at a lower level, sensory information such as "hot" or "cold" is placed at a middle level, and information indicating a comfort level such as "comfortable" or "uncomfortable", which is abstract value judgment, is placed at an upper level.

Figure 3:
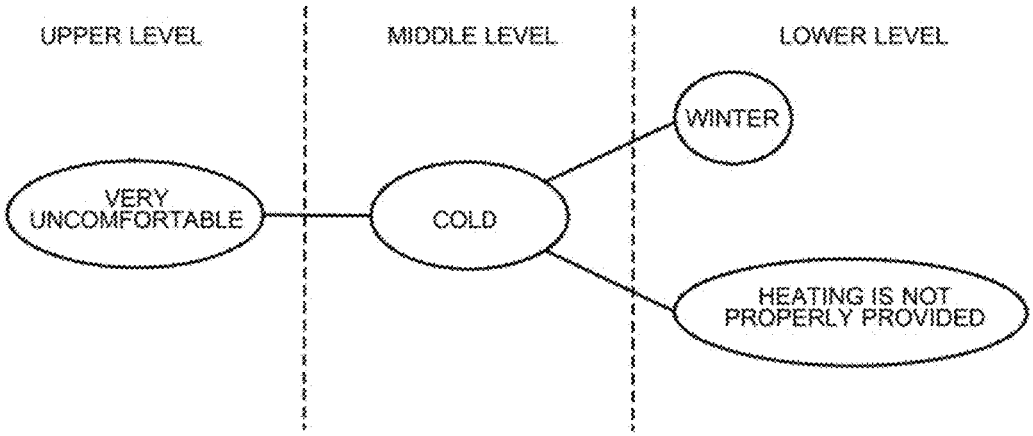
FIG. 3 is an illustration depicting an example of a cognitive-structure model.

Specifically, a process of information designation in the cognitive-structure model will be described below. The cognitive-structure constructing unit 14 acquires a comfort level from the content of a reply based on a rating method and designates the comfort level as an upper-level concept. Then, the cognitive-structure constructing unit 14 uses the content of a next reply based on a free-description method to extract a word, a phrase, or a text, such as an adjective or a noun, which represents a sensory experience leading to the comfort level. A word, a phrase, or a text that is extracted, which is sensory information, is set at the middle level. Further, the cognitive-structure constructing unit 14 uses the content of the reply based on a free-description method to extract a word, a phrase, or a text, such as an adjective or a noun, which represents at least one environmental factor leading to the comfort level and the sensory experience. A word, a phrase, or a text that is extracted, which is information representing an environmental factor, is set at the lower level. FIG. 3 is an illustration depicting an example of a cognitive-structure model. FIG. 3 depicts a cognitive-structure model created when the pointer is set to "1" in Question 1, text data representing "cold" is set in Question 2, and further text data representing "heating is not properly provided even in winter" is set in Question 2 in the questionnaire depicted in FIG. 2. As depicted in FIG. 3, the cognitive-structure constructing unit 14 constructs a cognitive-structure model that designates "very uncomfortable" as the upper-level concept, "cold" as the middle-level concept, and "winter" and "heating is not properly provided" as lower-level items. The content of the cognitive-structure model is, for example, added and modified every time a questionnaire is administered.

The cognitive-structure model reveals one or more factors to be controlled to improve the comfort of the user and one or more control actions. For example, in the example in FIG. 3, a factor to be controlled is the air temperature and examples of a control action include starting the heating operation of an air-conditioning apparatus and raising a temperature setting for the heating operation. When multiple environmental factors are linked with a comfort level, factors to be controlled to improve the comfort of the user and control actions are sometimes unclear. For example, in a cognitive-structure model, when information indicating discomfort is linked with sensory information indicating cold and further linked with information indicating a strong air flow and information indicating that heating is not properly provided, it may be unclear whether to control the air flow with high priority or whether to control the temperature with high priority. Since Question 3 illustrated in FIG. 2 requests a reply about a comfort level due to each environmental factor, the comfort-analyzing device 1 is able to extract which environmental factor most affects the comfort level and extract which environmental factor is to be controlled with high priority.

The cognitive-structure constructing unit 14 may include, in association with the comfort level, at least one of the parameters such as an air flow, a sound, a luminous intensity, weather, climate, a lifestyle, a physical condition, a season, and a humidity level, in addition to the sense of heat or cold, in a cognitive-structure model as a cause of the comfort level. This process reveals the effect exerted on the comfort of the user by a parameter such as an air flow or a sound.

The property-analyzing unit 15 is configured to analyze a property relevant to the comfort of the user based on the cognitive-structure model constructed by the cognitive-structure constructing unit 14. Specifically, the property-analyzing unit 15 classifies a property of the user based on a statistical analysis, such as a cluster analysis, by information representing at least one environmental factor that affects comfort, the information being represented by a cognitive-structure model. For example, if the property-analyzing unit 15 is able to identify the user as having a tendency to feel heat at a lower temperature than other users based on the cognitive-structure model, the user is classified as being sensitive to heat. In this case, the comfort-analyzing device 1 may include a temperature sensor that measures a room temperature or that acquires the room temperature from the temperature sensor. The comfort-analyzing device 1 is able to classify the user as being sensitive to heat based on a cognitive-structure model that represents a cause-effect relationship between the acquired room temperature and the comfort level of the user.

If a cognitive-structure model also includes at least one of the parameters such as an air flow, a sound, a luminous intensity, weather, climate, a lifestyle, a physical condition, a season, and a humidity level, in addition to the sense of heat or cold, as an environmental factor, the property-analyzing unit 15 is able to classify the comfort of the individual user in more detail by the cognitive-structure model.

Figure 4:
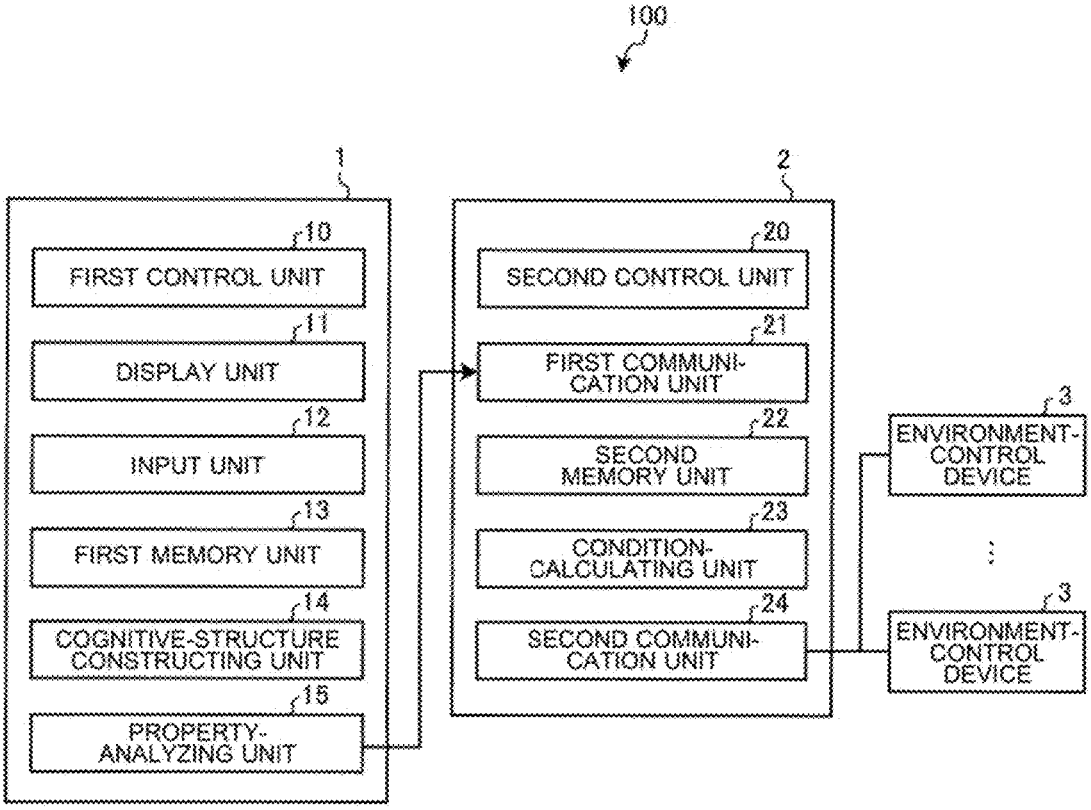
FIG. 4 is a diagram illustrating a configuration of a comfortable-environment creation system.

An analysis result obtained by the property-analyzing unit 15 is used in a comfortable-environment creation system 100 illustrated in FIG. 4. The comfortable-environment creation system 100 will be described below with reference to FIG. 4. FIG. 4 is a diagram illustrating a configuration of the comfortable-environment creation system. The comfortable-environment creation system 100 includes the comfort-analyzing device 1, which is described above, an environment-control command device 2, and one or more environment-control devices 3. The environment-control command device 2 is configured to acquire, from the comfort-analyzing device 1, an analysis result obtained by the property-analyzing unit 15 in the comfort-analyzing device 1. The environment-control command device 2 is configured to thereafter give a command to each of the environment-control devices 3 in accordance with the analysis result so that a comfortable environment is provided to the user.

Each of the environment-control device 3 is configured to control an environmental condition such as an air temperature, an air flow, a humidity level, a luminous intensity, or a color temperature. Examples of the environment-control device 3 include a device for controlling an air temperature, such as an air-conditioning apparatus, a heating appliance, or a cooling appliance, a device for controlling an air flow, such as an air-conditioning apparatus or an electric fan, a device for controlling a humidity level, such as a humidifier or a dehumidifier, and a device for controlling a luminous intensity or a color temperature, such as a lighting appliance.

The environment-control command device 2 includes a second control unit 20, a first communication unit 21, a second memory unit 22, a condition-calculating unit 23, and a second communication unit 24. The second control unit 20 is configured to control, for example, the first communication unit 21, the condition-calculating unit 23, and the second communication unit 24. The first communication unit 21 is configured to communicate with the comfort-analyzing device 1 in accordance with an instruction from the second control unit 20 and acquire, from the comfort-analyzing device 1, the analysis result obtained by the property-analyzing unit 15.

The second memory unit 22 is configured to store information regarding parameters for each of the environment-control devices 3. The parameters are related to processing performed by the environment-control devices 3. For example, if one of the environment-control devices 3 is an air-conditioning apparatus, the parameters for this device include a temperature setting, whether to cool or heat, and the amount of air flow.

The condition-calculating unit 23 is configured to calculate an environmental condition necessary to create the most suitable environment for achieving the comfort of the user. The calculation is based on the analysis result obtained by the property-analyzing unit 15. For example, if the user feels most comfortable at a room temperature of 22 degrees C., the environmental condition is to keep the room temperature at 22 degrees C. The environmental condition necessary for the comfort of the user represents the parameter to be controlled for the environment-control device 3 and the value of the parameter to be set. In the case of the environmental condition being a room temperature of 22 degrees C. as described above, the parameter to be controlled corresponds to the temperature setting of an air-conditioning apparatus, and the value of the temperature setting to be set in Celsius is 22. Thus, the environment-control command device 2 is configured to calculate the value of a parameter for each of the environment-control devices 3 as an environmental condition necessary for the comfort of the user. The value of the parameter is also referred to as a parameter value in some cases.

The second communication unit 24 is configured to communicate with each of the environment-control devices 3 in accordance with an instruction from the second control unit 20. In accordance with an instruction from the second control unit 20, the second communication unit 24 transmits, to each of the environment-control devices 3, a command to perform a process based on the parameter value calculated by the condition-calculating unit 23. For example, if the analysis result obtained by the property-analyzing unit 15 indicates that the user is sensitive to heat and that the user is not comfortable at the air temperature at the time of survey, the environment-control command device 2 either gives a command to an environment-control device 3 such as an air-conditioning apparatus or a cooling appliance so that the current air temperature is lowered to a temperature lower than the air temperature at the time of survey or gives a command to an environment-control device 3 such as an air-conditioning apparatus or an electric fan so that an air flow is provided to the user.

Hardware configurations of the comfort-analyzing device 1 and the environment-control command device 2, which are described above, will be described below. Functions of the comfort-analyzing device 1 can be provided by a configuration including, for example, a processor such as a central processing unit (CPU) or a microprocessing unit (MPU), a memory such as a read only memory (ROM) or a random access memory (RAM), a display device including, for example, a liquid crystal display or a cathode ray tube (CRT), an input device such as a keyboard, a mouth, or a touch panel, a storage device such as a hard disk drive (HDD), and a communication interface circuit. The function of the display unit 11 can be provided by the display device. The function of the input unit 12 can be provided by the input device. The function of the first memory unit 13 can be provided by the storage device or the memory. The control function of the first control unit 10, the function of the cognitive-structure constructing unit 14 to construct a cognitive-structure model, and the analyzing function of the property-analyzing unit 15 are provided by the processor loading and executing various programs stored in the memory. The cognitive-structure constructing unit 14 may save the constructed cognitive-structure model to the first memory unit 13. Alternatively, the constructed cognitive-structure model may be saved to the cognitive-structure constructing unit 14, in which case, a storage function of the cognitive-structure constructing unit 14 can be provided by the memory or the storage device, which are described above. The function of the property-analyzing unit 15 to output an analysis result to the environment-control command device 2 can be provided by the communication interface circuit described above. All or some of the functions of the comfort-analyzing device 1 may be provided by dedicated hardware.

Functions of the environment-control command device 2 can be provided by a configuration including, for example, a processor such as a CPU or an MPU, a memory such as a ROM or a RAM, a communication interface circuit, and a storage device such as an HDD. Functions of the second control unit 20 and the condition-calculating unit 23 can be provided by a processor loading and executing various programs stored in the memory. The functions of the first communication unit 21 and the second communication unit 24 can be provided by the communication interface circuit. The function of the second memory unit 22 can be provided by the memory or the storage device. All or some of the functions of the environment-control command device 2 may be provided by dedicated hardware.

Figure 5:
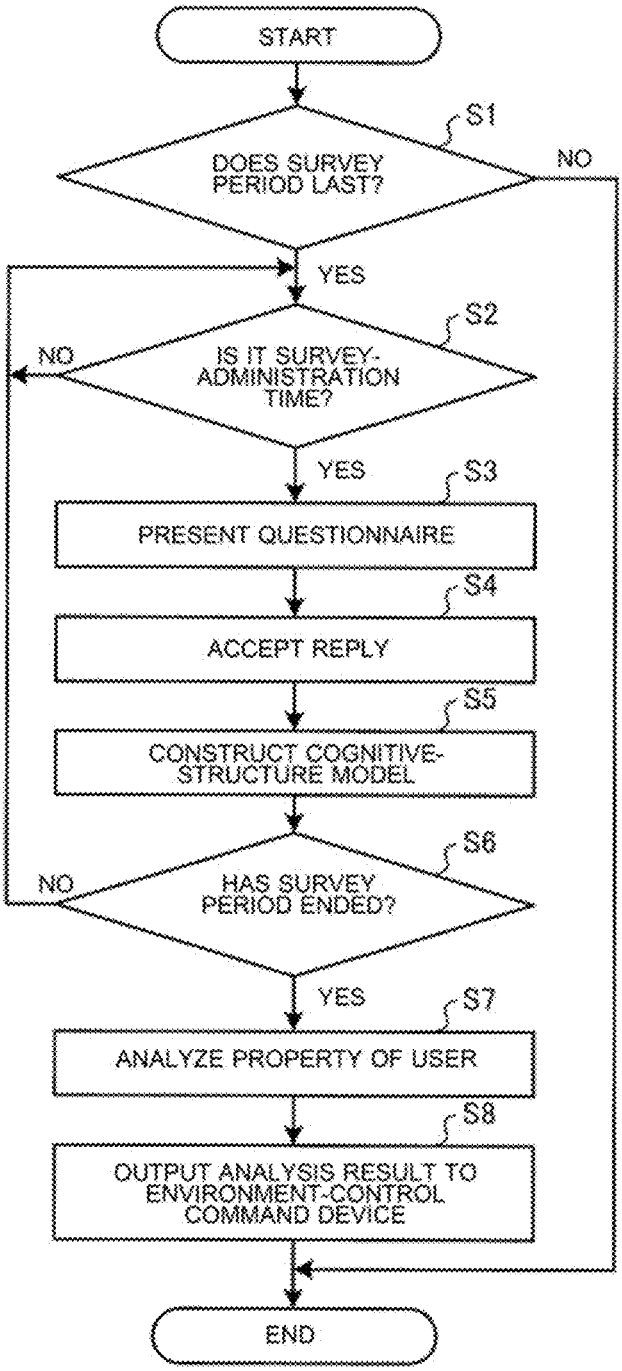
FIG. 5 is a flowchart illustrating an analysis process performed by the comfort-analyzing device.
Figure 6:
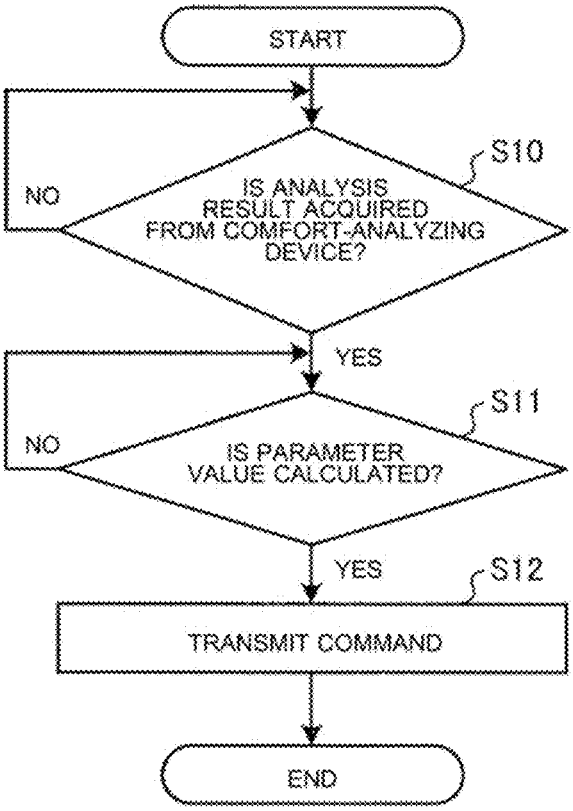
FIG. 6 is a flowchart illustrating an environment-control process performed by an environment-control command device and an environment-control device.

The flow of a process in the comfortable-environment creation system 100 according to Embodiment 1 will be described with reference to FIGS. 5 and 6 below. FIG. 5 is a flowchart illustrating an analysis process performed by the comfort-analyzing device. FIG. 6 is a flowchart illustrating an environment-control process performed by the environment-control command device and the one or more environment-control devices.

In step S1 depicted in FIG. 5, the first control unit 10 determines whether the survey period lasts at present. If the survey period does not last at present (NO in step S1), the comfort-analyzing device 1 ends the process. If the survey period lasts at present (YES in step S1), the first control unit 10 determines in step S2 whether the current time coincides with a survey-administration time. A survey-administration time is a time when a questionnaire is scheduled to be administered. A questionnaire may be administered at specified time points, at predetermined intervals, or at intervals selected at random.

If the first control unit 10 determines in step S2 that the current time does not coincide with a survey-administration time (NO in step S2), the first control unit 10 returns the process to step S2 and waits until a survey-administration time. If it is determined that the current time coincides with a survey-administration time (YES in step S2), in step S3, the first control unit 10 causes the display unit 11 to present a questionnaire based on a rating method and a free-description method as illustrated in FIG. 2. The display unit 11 presents the questionnaire in accordance with an instruction from the first control unit 10. In step S4, the input unit 12 accepts a reply to the questionnaire from the user. In this particular example, description will be given on the assumption that a reply from the user is input into the comfort-analyzing device 1 without fail.

In step S5, the cognitive-structure constructing unit 14 constructs a cognitive-structure model of the user based on the result of the survey. In step S6, the first control unit 10 determines whether the survey period has ended. If it is determined that the survey period has not ended (NO in step S6), the first control unit 10 returns the process to step S2. If it is determined that the survey period has ended (YES in step S6), in step S7, the property-analyzing unit 15 analyzes a property of the user by a statistical analysis method, such as a cluster analysis, based on the cognitive-structure model. In step S8, the property-analyzing unit 15 outputs the analysis result to the environment-control command device 2. After the processing in step S8, the comfort-analyzing device 1 ends the process.

In the process depicted in FIG. 5, the cognitive-structure constructing unit 14 constructs a cognitive-structure model in step S5 every time a reply to the questionnaire is entered in step S4. In this way, data is added to the cognitive-structure model or the cognitive-structure model is updated every time the questionnaire is administered during the survey period. However, instead of this procedure, the cognitive-structure constructing unit 14 may construct a cognitive-structure model when the questionnaire is administered a fixed times. Alternatively, the cognitive-structure constructing unit 14 may construct a cognitive-structure model when the data representing the result of the survey reaches a fixed amount. In such cases, the first control unit 10 may accumulate and store, in the first memory unit 13, the result of the survey acquired by the questionnaire administered multiple times, and the cognitive-structure constructing unit 14 may create a cognitive-structure model from the content of the accumulated result of the survey. In the case where the process depicted in FIG. 5 is performed, the comfort-analyzing device 1 need not include the first memory unit 13.

In step S10 depicted in FIG. 6, the second control unit 20 determines whether the first communication unit 21 has acquired the analysis result from the property-analyzing unit 15 in the comfort-analyzing device 1. While the first communication unit 21 has not acquired the analysis result (NO in step S10), the environment-control command device 2 keeps the process in step S10. When the first communication unit 21 has acquired the analysis result (YES in step S10), in step S11, the condition-calculating unit 23 calculates a parameter value for each of the environment-control devices 3 to create the environment most suitable for the comfort of the user. In step S12, the second control unit 20 causes the second communication unit 24 to transmit a command to each of the environment-control devices 3, the command causing the environment-control device 3 to perform a process based on the parameter value calculated by the condition-calculating unit 23. In accordance with an instruction from the second control unit 20, the second communication unit 24 transmits the command to each of the environment-control devices 3. Thereafter, the process performed by the environment-control command device 2 ends.

Effects produced by the comfort-analyzing device 1 and the environment-control command device 2 according to Embodiment 1 will be described below. The comfort-analyzing device 1 according to Embodiment 1 includes the display unit 11, the first control unit 10, the input unit 12, and the cognitive-structure constructing unit 14. The display unit 11 is configured to present a questionnaire for extracting both a comfort level of a user in an environment and at least one environmental factor to determine the comfort level. The first control unit 10 is configured to cause the display unit 11 to present the questionnaire twice or more during a survey period. The input unit 12 is configured to accept, from the user, input of each reply to the questionnaire presented twice or more. The cognitive-structure constructing unit 14 is configured to construct a cognitive-structure model representing a cognitive structure of the user by extracting the comfort level and the at least one environmental factor in chronological order based on each reply to the questionnaire presented twice or more. In this way, the comfort-analyzing device 1 is able to construct a precise cognitive-structure model by the comfort level and the at least one environmental factor, which are extracted in chronological order.

The display unit 11 according to Embodiment 1 is configured to present a questionnaire asking the user about a comfort level based on a rating method. The input unit 12 is configured to accept, from the user, a reply including the comfort level that is rated. In this way, the comfort level of the user is revealed quantitatively, and the comfort-analyzing device 1 is able to construct a more precise cognitive-structure model.

The display unit 11 according to Embodiment 1 is configured to present a questionnaire asking the user about at least one environmental factor based on a free-description method. The input unit 12 is configured to accept, from the user, a reply including information based on a description about the at least one environmental factor. In this way, the comfort-analyzing device 1 is able to flexibly acquire information indicating a cause of the comfort of the user. For example, the comfort-analyzing device 1 is configured to acquire parameters such as the sense of heat, an air flow, a sound, a luminous intensity, weather, climate, a lifestyle, a physical condition, a season, or a humidity level as an environmental factor and is able to construct a more precise cognitive-structure model.

The cognitive-structure constructing unit 14 according to Embodiment 1 is configured to construct a cognitive-structure model based on a reply by the evaluation grid method. In this way, the cognitive-structure constructing unit 14 is able to create a hierarchical cognitive-structure model having the comfort level of the user as information at the upper level, sensory information as information at the middle level, and at least one environmental factor as information at the lower-level.

The display unit 11 according to Embodiment 1 is configured to present a questionnaire asking the user about an alertness level. The input unit 12 is configured to accept a reply representing the alertness level from the user. The cognitive-structure constructing unit 14 is configured to use a reply representing the alertness level higher than or equal to a threshold when constructing a cognitive-structure model. In this way, the cognitive-structure constructing unit 14 is able to reduce a processing load when constructing the cognitive-structure model. Further, the cognitive-structure constructing unit 14 is able to construct a precise cognitive-structure model by an accurate reply from an alert user.

The comfort-analyzing device 1 according to Embodiment 1 further includes the property-analyzing unit 15. The property-analyzing unit 15 is configured to analyze a property relevant to the comfort of the user based on the cognitive-structure model constructed by the cognitive-structure constructing unit 14 for the user. In this way, the comfort-analyzing device 1 is able to more accurately analyze a property of the user, such as being sensitive to heat or cold, by a precise cognitive-structure model constructed based on the comfort level and the at least one environmental factor acquired in chronological order by the questionnaire.

The property-analyzing unit 15 according to Embodiment 1 is configured to analyze the property of the user by a statistical analysis method. For example, the property-analyzing unit 15 is able to analyze the property of the user by classifying the property of the user based on the cluster analysis.

The environment-control command device 2 according to Embodiment 1 is configured to give a command to the one or more environment-control devices 3 based on the analysis result obtained by the comfort-analyzing device 1, the one or more environment-control devices being configured to control an environment. The environment-control command device 2 includes the first communication unit 21, the condition-calculating unit 23, the second communication unit 24, and the second control unit 20. The first communication unit 21 is configured to acquire the analysis result representing the property of the user from the comfort-analyzing device 1. The condition-calculating unit 23 is configured to calculate an environmental condition for the user by the analysis result acquired by the first communication unit 21. The second communication unit 24 is configured to communicate with the one or more environment-control devices 3. The second control unit 20 is configured to cause the second communication unit 24 to transmit, to the one or more environment-control devices 3, a command to cause the one or more environment-control devices 3 to perform a process based on the environmental condition calculated by the condition-calculating unit 23. In summary, the environment-control command device 2 is configured to use the analysis result representing the property of the user analyzed by the comfort-analyzing device 1 based on a precise cognitive-structure model, calculate the environmental condition for improving the comfort of the user, and gives each of the environment-control devices 3 a command to perform a process based on the calculated environmental condition. In this way, the comfort of the user is improved in the environment.

The comfort-analyzing device 1 may include an output unit such as a printer for printing a questionnaire instead of the display unit 11 or along with the display unit 11. The input unit 12 in the comfort-analyzing device 1 may include a device such as a scanner. In such a case, the user may enter a reply on a printed questionnaire by using, for example, a pen or a pencil and scan the filled questionnaire by using the input unit 12. The cognitive-structure constructing unit 14 may extract the comfort level of the user and the at least one environmental factor that determines the comfort level from the content of the scanned questionnaire.

Embodiment 2

In Embodiment 1, description is given with regard to the case where the comfort-analyzing device 1 is configured to analyze the comfort of one user and where the environment-control command device 2 is configured to give each of the environment-control devices 3 a command to perform a process based on an environmental condition for improving the comfort of the user. A comfort-analyzing device 1 according to Embodiment 2 is configured to provide a comfortable environment to multiple users individually. The comfort-analyzing device 1 and an environment-control command device 2 according to Embodiment 2 will be described below. A component that is similar to a component in Embodiment 1 described above and that has a similar function is denoted by a symbol similar to the symbol in Embodiment 1. A component, a function, and an action that are similar to a component, a function, and an action, respectively, in Embodiment 1 will not be described unless otherwise noted.

In Embodiment 2, a different survey-administration time is set for each of the multiple users. In this case, a survey period for each of the multiple users may be the same or different. Instead of setting a different survey-administration time for each of the multiple users, the comfort-analyzing device 1 may include multiple display units 11 and multiple input units 12, cause each of the multiple display units 11 to present a questionnaire as described above at the same survey-administration time, and accept input of a reply from each of the multiple users into the corresponding one of the input units 12. Alternatively, the comfort-analyzing device 1 may cause one or more other devices to present a questionnaire as described above via communication, and receive a reply from each of the one or more other devices, the reply being input into the device by one of the users.

The cognitive-structure constructing unit 14 is configured to construct a cognitive-structure model of each of the multiple users. The content of the cognitive-structure model constructed by the cognitive-structure constructing unit 14 for each user is similar to the content of the cognitive-structure model in Embodiment 1 described above. The property-analyzing unit 15 is configured to classify the multiple users based on the property of each of the multiple users, the property being obtained by the cognitive-structure model of the user. Specifically, the property-analyzing unit 15 determines, for example, whether a piece of information representing a factor specifying the property of one of the multiple users is identical or similar to another piece of information representing a factor specifying the property of another of the multiple users, the piece of information being a word, a phrase, or a text, such as an adjective or a noun. Then, the property-analyzing unit 15 classifies two or more of the multiple users into a group, the properties of the two or more users being identical or similar to each other. Further, the property-analyzing unit 15 classifies two or more of the multiple users into different groups, the properties of the two or more users being dissimilar to each other.

The property-analyzing unit 15 is configured to output an analysis result representing the properties of the users in each group to the environment-control command device 2. The condition-calculating unit 23 in the environment-control command device 2 is configured to calculate an environmental condition for each group. The second control unit 20 in the environment-control command device 2 is configured to give, via the second communication unit 24, each of the environment-control devices 3 a command to perform a process based on the environmental condition for each group. The one or more environment-control devices 3 are able to collectively provide a comfortable environment to the users in the group by operating in accordance with the command from the environment-control command device 2.

The above process, in which the multiple users are classified in accordance with the property, may be performed not by the property-analyzing unit 15 but by the condition-calculating unit 23 in the environment-control command device 2, which acquires the analysis result regarding the property of each user from the property-analyzing unit 15. Then, the condition-calculating unit 23 may calculate an environmental condition for each of the groups obtained by the classification.

The property-analyzing unit 15 or the condition-calculating unit 23 may further classify two or more users in a group in accordance with the property. In this case, before the classifying process, the property-analyzing unit 15 analyzes two or more properties of each user. For example, the property-analyzing unit 15 analyzes a property related to the sensitivity to heat and a property related to humidity for each user and reveals through an analysis process that, for example, a user has a property of "being sensitive to heat" and a property of "having a tendency to sweat" and that another user has a property of "being sensitive to heat" and a property of "having a tendency not to sweat". In such a case, if classification according to the property of "being sensitive to heat" is already done, the property-analyzing unit 15 or the condition-calculating unit 23 further classifies users in accordance with whether a user has "a tendency to sweat". In this way, the property-analyzing unit 15 or the condition-calculating unit 23 is able to perform more precise classification with regard to the comfort of each user. Accordingly, the condition-calculating unit 23 is able to calculate an environmental condition for providing more comfortable environment to each group obtained by subdivision in this way. Each environment-control device 3 is able to create a more comfortable environment for each group by performing a process in accordance with the environmental condition calculated in this way. For example, the one or more environment-control devices 3 provide a cool room temperature together with a low humidity level or an air flow to a group of users who are "sensitive to heat" and have "a tendency to sweat" and provide a cooler room temperature to a group of users who are "sensitive to heat" and have "a tendency not to sweat", further improving the comfort for each group.

Further, since the property-analyzing unit 15 is configured to analyze multiple attributes of each user, the condition-calculating unit 23 in the environment-control command device 2 is able to calculate an environmental condition that further improves the comfort of the user. Then, the one or more environment-control devices 3 are able to further improve the comfort of the user by operating based on the environmental condition.

Effects produced by the comfort-analyzing device 1 and the environment-control command device 2 according to Embodiment 2 will further be described below. The input unit 12 according to Embodiment 2 is configured to accept a reply to a questionnaire from each of the multiple users. The property-analyzing unit 15 is configured to analyze the property of each of the multiple users. The property-analyzing unit 15 or the condition-calculating unit 23 is configured to classify two or more users of the multiple users into a group, the properties of the two or more users being identical or similar to each other. The condition-calculating unit 23 is configured to calculate an environmental condition for each group. For each group, the second control unit 20 is configured to cause the second communication unit 24 to transmit, to the one or more environment-control devices 3, a command to cause the one or more environment-control devices 3 to perform a process based on the environmental condition calculated by the condition-calculating unit 23 for the group. In this way, the comfortable-environment creation system 100 is able to collectively provide a comfortable environment to all the users in the group.

Embodiment 3

The environment-control command devices 2 according to Embodiment 1 and Embodiment 2, which are described above, are configured to calculate the environmental condition most suitable to a user by a result of an analysis performed by the property-analyzing unit 15 based on a cognitive-structure model created by the cognitive-structure constructing unit 14 in the comfort-analyzing device 1 based on a subjective comfort level of the user. However, using biological information of the user in addition to the subjective comfort level to calculate the environmental condition enables the comfort of the user to be objectively determined, further improving the environment for the user. An environment-control command device 4 according to Embodiment 3 is to create an environment more suitable to a user also by biological information of the user to calculate an environmental condition. The biological information can be an objective index of the comfort of the user. The environment-control command device 4 according to Embodiment 3 will be described below. A component that is similar to a component in Embodiment 1 and Embodiment 2, which are described above, and that has a similar function is denoted by a symbol similar to the symbol in Embodiment 1 and Embodiment 2. A component, a function, and an action that are similar to a component, a function, and an action, respectively, in Embodiment 1 and Embodiment 2, which are described above, will not be described unless otherwise noted.

Figure 7:
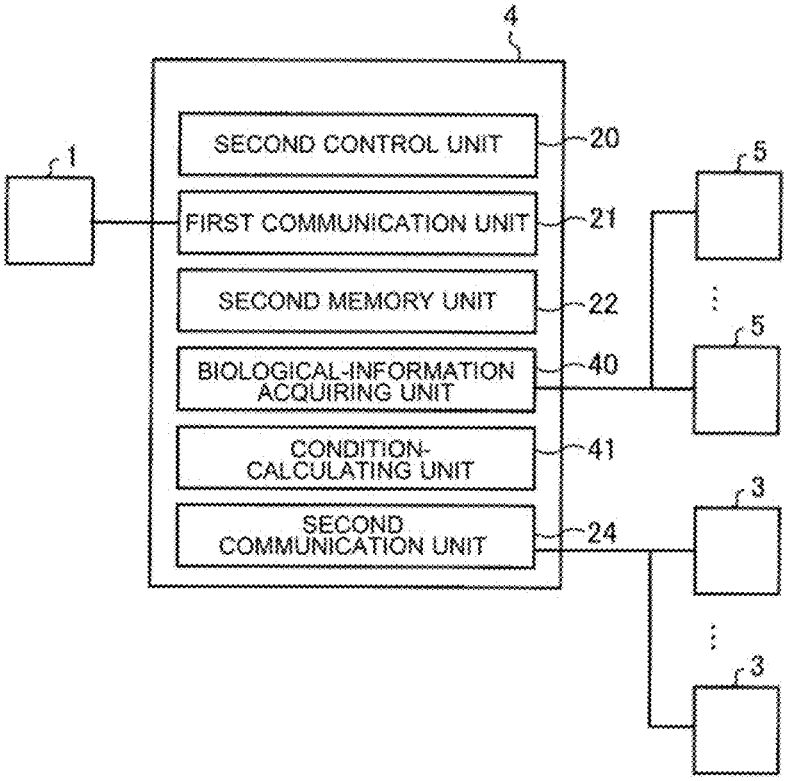
FIG. 7 is a diagram illustrating functional blocks included in an environment-control command device according to Embodiment 3.

FIG. 7 is a diagram illustrating functional blocks included in the environment-control command device according to Embodiment 3. In addition to the units included in the environment-control command device 2 described above, the environment-control command device 4 according to Embodiment 3 further includes a biological-information acquiring unit 40 and includes a condition-calculating unit 41 instead of the condition-calculating unit 23 included in the environment-control command device 2 described above.

The biological-information acquiring unit 40 is configured to acquire, from one or more sensors 5, at least one piece of data of a user regarding, for example, a brain wave, electrocardiogram, a heartbeat, a skin temperature, nictitation, a yawn, the amount of sweat, the amount of amylase secretion, and a body movement. A piece of such data is also referred to as a piece of biological information. A skin temperature among these pieces of data represents a skin temperature of a body part exposed to air, such as a hand or a face of the user. However, the skin temperature may be an average of skin temperatures of multiple body parts exposed to air. Each of the sensors 5 is configured to measure a piece of biological information in real time. The biological-information acquiring unit 40 is configured acquire a piece of biological information from each of the sensors 5 in real time.

The condition-calculating unit 41 is configured to calculate the environmental condition most suitable to the user by one or more pieces of biological information acquired from the one or more sensors 5 in addition to an analysis result acquired from the comfort-analyzing device 1 regarding the property of the user based on the subjective comfort level of the user. Specifically, the condition-calculating unit 41 is configured to extract a piece of biological information from the pieces of biological information of the user acquired by the biological-information acquiring unit 40 from the one or more sensors 5, the piece of biological information being expected to objectively reflect the comfort of the user based on the above property indicated by the analysis result acquired from the comfort-analyzing device 1. The condition-calculating unit 41 is configured to calculate a parameter value for each of the environment-control devices 3 by the extracted piece of biological information. In more detail, the condition-calculating unit 41, in advance, keeps data indicating that, for example, a skin temperature of a limb of a user who is oversensitive to cold reflects the comfort of the user. In such a case, if an analysis result obtained by the comfort-analyzing device 1 indicates that the user is oversensitive to cold, the condition-calculating unit 41 extracts a piece of biological information indicating a skin temperature of a limb of the user. Subsequently, the condition-calculating unit 41 calculates a parameter value for each of the environment-control devices 3 by the piece of biological information indicating the skin temperature of the limb.

The second control unit 20 is configured to give, via the second communication unit 24, each of the environment-control devices 3 a command to perform a process based on the environmental condition calculated by the condition-calculating unit 41.

Effects produced by the environment-control command device 4 according to Embodiment 3 will be described below. The environment-control command device 4 according to Embodiment 3 further includes the biological-information acquiring unit 40 configured to acquire one or more pieces of biological information of the user from one or more sensors. The condition-calculating unit 41 according to Embodiment 3 is configured to extract a piece of biological information from the one or more pieces of biological information, the piece of biological information being expected to affect the comfort based on the property indicated by the analysis result obtained by the comfort-analyzing device 1. The condition-calculating unit 41 is configured to thereafter calculate an environmental condition by the extracted piece of biological information. Since the environment-control command device 4 is configured to give one or more environment-control devices 3 a command to perform a process based on the environment and each of the one or more environment-control devices 3 is configured to operate based on the command, an environment that improves the comfort of the user more rapidly and that is necessary for the body of the user can be created.

REFERENCE SIGNS LIST

1: comfort-analyzing device, 2, 4: environment-control command device, 3: environment-control device, 5: sensor, 10: first control unit, 11: display unit, 12: input unit, 13: first memory unit, 14: cognitive-structure constructing unit, 15: property-analyzing unit, 20: second control unit, 21: first communication unit, 22: second memory unit, 23, 41: condition-calculating unit, 24: second communication unit, 40: biological-information acquiring unit, 100: comfortable-environment creation system

The invention claimed is:

1. A comfort-analyzing device configured to analyze comfort, of a user, the comfort-analyzing device comprising:

input circuitry configured to accept a plurality of inputs from the user, at each of a plurality of different time points, of a current comfort level of the user, and separately sensory information representing sensation of the user associated with the input current comfort level of the user and information representing an environmental factor that caused the input of the current comfort level of the user from the user; and cognitive-structure constructing circuitry configured to construct a cognitive-structure model regarding the comfort of the user by extracting the input current comfort level, the sensory information, and the information representing the environmental factor, in chronological order, wherein the cognitive-structure constructing circuitry is configured to construct the constructed cognitive model such that the input current comfort level is placed at an upper level, the sensory information is placed at a middle level, and the information representing the environmental factor is placed at a lower level, and wherein the input circuitry is configured to accept as one of the inputs from the user a reply, inputted after the input of the current comfort level, the sensory information, and the information representing the environmental factor, that links the environmental factor with the input current comfort level of the user.

2. The comfort-analyzing device of claim 1, wherein the input circuitry is configured to accept the input of the current comfort level that is rated based on a rating method.

3. The comfort-analyzing device of claim 1, wherein the input circuitry is configured to accept the input of the sensory information and the environmental factor, based on a free-description method.

4. The comfort-analyzing device of claim 1, wherein the cognitive-structure constructing circuitry is configured to construct, based on an evaluation grid method, the cognitive-structure model.

5. The comfort-analyzing device of claim 1, wherein the input circuitry is configured to accept representing input of information representing alertness level from the user at each of the plurality of different time points, and wherein the cognitive-structure constructing circuitry is configured to use the input current comfort level, the sensory information, and the information representing the environmental factor, accepted by the input circuitry at the time point when the alertness level is higher than or equal to a threshold, when constructing the cognitive-structure model.

6. The comfort-analyzing device of claim 1, further comprising:

property-analyzing circuitry configured to analyze a property of the user relevant to comfort of the user based on the cognitive-structure model constructed by the cognitive-structure constructing circuitry regarding the user.

7. The comfort-analyzing device of claim 6, wherein the property-analyzing circuitry is configured to analyze the property associated with the user based on a statistical analysis method.

8. The comfort-analyzing device of claim 6, wherein the input circuitry is configured to accept input, at each of a plurality of different time points, of the level of comfort of each of a plurality of users, the sensory information representing sensation of each of the plurality of users, and the environmental factor being a cause of the comfort level of each of the plurality of users, and wherein the property-analyzing circuitry is configured to analyze the property associated with each of the plurality of users and classify two or more users of the plurality of users into a group, the properties of the two or more users being identical or similar to each other.

9. An environment-control command device configured to analyze comfort of each of a plurality of users, give a command to one or more environment-control devices based on an analysis result obtained by a comfort-analyzing device, the one or more environment-control devices being configured to control environment, the comfort-analyzing device being configured to for each of the users, accept a plurality of inputs from the user, at each of a plurality of different time points, of input of a current comfort level of the user, and separately sensory information representing sensation of the user associated with the input current comfort level of the user and an environmental factor that caused the input of the current comfort level of the user as input by the user, for each of the users, construct a cognitive-structure model of the user regarding comfort by extracting the input current comfort level, the sensory information, and the information representing the environmental factor, which are input as the inputs for the user, and for each of the users, analyze a property of the user relevant to the comfort of the user based on the cognitive-structure model, the constructed cognitive model being configured such that the input current comfort level is placed at an upper level, the sensory information is placed at a middle level, and the information representing the environmental factor is placed at a lower level, the environment-control command device comprising:

a first communication circuitry configured to acquire an analysis result representing the property of each of the users from the comfort-analyzing device;

a condition-calculating circuitry configured to calculate an environmental condition for each of the users based on the analysis result acquired by the first communication circuitry;

a second communication circuitry configured to communicate with the one or more environment-control devices; and a second control circuitry configured to cause the second communication circuitry to transmit, to the one or more environment-control devices, a command to cause the one or more environment-control devices to perform a process based on the environmental condition calculated by the condition-calculating circuitry, wherein the comfort-analyzing device is configured to accept as one of the inputs from each of the users a reply, inputted after the input of the current comfort level, the sensory information, and the information representing the environmental factor, to link the environmental factor with the input current comfort level of the user.

10. The environment-control command device of claim 9, wherein the comfort-analyzing device is configured to for each of the users, analyze the property of each of the plurality of users, and classify two or more users of the plurality of users into a group, the properties of the two or more users being identical or similar to each other, wherein the condition-calculating circuitry is configured to calculate the environmental condition for the group, and wherein the second control circuitry is configured to cause the second communication circuitry to transmit, to the one or more environment-control devices, a command for the group to cause the one or more environment-control devices to perform a process based on the environmental condition for the group.

11. The environment-control command device of claim 9, wherein the comfort-analyzing device is configured to analyze the property of each of the plurality of users, wherein the first communication circuitry is configured to acquire the analysis result representing the property of each of the plurality of users from the comfort-analyzing device, wherein the condition-calculating circuitry is configured to classify two or more users of the plurality of users into a group, the properties of the two or more users being identical or similar to each other, and calculate the environmental condition for the group, and wherein the second control circuitry is configured to cause the second communication circuitry to transmit, to the one or more environment-control devices, a command for the group to cause the one or more environment-control devices to perform a process based on the environmental condition for the group.

12. The environment-control command device of claim 9, further comprising:

a biological-information acquiring circuitry configured to acquire one or more pieces of biological information of each of the users from one or more sensors, wherein the condition-calculating circuitry is configured to extract a piece of biological information from the one or more pieces of biological information, the piece of biological information being expected to objectively reflect the input current comfort level based on the property represented by the analysis result, and calculate the environmental condition based on the piece of biological information that is extracted.

13. A comfort-analyzing method executed by a comfort-analyzing device configured to analyze comfort of a user, the comfort-analyzing method comprising:

accepting a plurality of inputs, at each of a plurality of different time points, of a current comfort level of the user, and separately sensory information representing sensation of the user associated with the input current comfort level of the user and information representing an environmental factor that caused the input of the current comfort level of the user by the user; and constructing a cognitive-structure model regarding the comfort of the user by extracting the input current comfort level, the sensory information, and the information representing the environmental factor, which are input in said accepting, in chronological order, wherein the constructed cognitive model is configured such that the input current comfort level is placed at an upper level, the sensory information is placed at a middle level, and the information representing the environmental factor is placed at a lower level, and wherein said accepting includes accepting, as one of the inputs from the user, a reply, inputted after the input of the current comfort level, the sensory information, and the information representing the environmental factor, linking the environmental factor with the input current comfort level of the user.

* * * * *